United States Patent [19]

Heggelund

[11] Patent Number: 4,523,065

[45] Date of Patent: Jun. 11, 1985

[54] TRIGGER OPERATED PANIC SAFETY SWITCH

[76] Inventor: Merel A. Heggelund, 314 N. Powers Ave., Manteca, Calif. 95336

[21] Appl. No.: 538,115

[22] Filed: Oct. 3, 1983

[51] Int. Cl.[3] ..... H01H 21/26

[52] U.S. Cl. ..... 200/157; 200/160

[58] Field of Search ..... 200/157, 153 M, 160

[56] References Cited

U.S. PATENT DOCUMENTS 2,747,840 8/1960 Park et al. ..... 200/160

3,117,206 1/1964 Bush ..... 200/157

FOREIGN PATENT DOCUMENTS 46-10378 3/1971 Japan ..... 200/160

*Primary Examiner*—Stephen Marcus

*Assistant Examiner*—Renee S. Kidorf

*Attorney, Agent, or Firm*—Robert Mednick

[57] ABSTRACT

A trigger operated panic safety switch is provided which has a trigger member and a switch enclosure with spaced apart electrical contact members located in an intermediate portion of the chamber. The trigger member drives a carrier with an interconnect member from an initial portion, through the intermediate portion, to an end portion of the chamber, and back again, in accordance with the pressure applied to its trigger member. The interconnect member enables contact members to be electrically connected to turn on the switch when the carrier is positioned in the intermediate portion of the chamber. The safety switch is also disclosed to have an insulator slide member which has an indentation to receive the interconnect member of the carrier in the end portion of the chamber to prevent electrical connection of the switch, and to be moved by the interconnect member until the carrier is returned to the initial portion of the chamber.

4 Claims, 10 Drawing Figures

TRIGGER OPERATED PANIC SAFETY SWITCH

FIELD OF THE INVENTION

The present invention relates to a trigger operated panic safety switch, and more particularly relates to a trigger operated panic safety switch for portable electrical power tools.

BACKGROUND OF THE INVENTION

In operating electric power tools, trigger switches are often used to enable an operator to manually turn on and off the power tools. The operator will grip a power tool with his hand around a handle, and his forefinger positioned on a trigger to selectively press and release it to operate the hand power tool. Such tools are portable in that they can be carried from place to place, either having their own power supply or being connectable to an electric power outlet to be ready for use. A person can manually grip the handle and be ready to perform the cutting or drilling work intended. Such portable power tools may be drills, saws, planers, etc. and other cutting means.

When using such portable power tools, accidents at times occur due to the cutting means of the power tool encountering unexpected hard objects. The reaction is such that the power tool is said at times to "kick-back" and then possibly injure the operator. A common reaction of the operator to such a kick-back reaction of the power tool is to "try harder" when a hard object worked on causes difficulty. Another reaction is to instinctively hold more tightly or grip harder, which is in the nature of a panic reaction. In any event, for these instances, the grip of the operator increases in intensity, which is often the cause of an accident.

Such accidents may be prevented if such an instinctive reaction of the operator to an unexpected power tool operation causes the shut-off of the electrical power tool.

SUMMARY OF THE INVENTION

Accordingly, these and other disadvantages of the prior art are overcome by this invention which provides a simple and inexpensive trigger operated panic safety switch for such portable electrical power tools. The invention includes switch means operated by trigger actuated means. The switch means includes a switch enclosure with electrical contact members located in a chamber in the switch enclosure. A carrier with interconnect contacts are provided to electrically connect the contact members when the carrier is positioned in a portion of the chamber. Trigger actuated means includes a pivoted or slide trigger actuated by finger pressure and connected by a connecting member to drive the carrier with its interconnect contacts from an initial portion, through the intermediate portion, to an end portion of the chamber, and back again. In the initial portion as well as in the end portion of the chamber, the interconnect contacts are not electrically connected to the contact members, so that with increased pressure as well as no pressure on the trigger, the power tool is turned off. In a preferred embodiment, providing an additional panic safety feature, an insulator slide member is also provided to carry the interconnect contacts when in the end portion of the chamber, and prevent electrical contact between the contact members until the carrier is returned to the initial portion of the chamber for the interconnect contacts.

OBJECTS OF THE INVENTION

It is therefore an object of this invention to provide a trigger operated panic safety switch for an electric power tool so that an operator can manually press the trigger to control the operation of the power tool.

Another object of this invention is to provide a trigger operated safety switch for an electric power tool that will respond to manual pressure to electrically turn on the power tool, and will respond to increased manual pressure due to panic reaction of the operator to electrically turn off the power tool.

Still another object of this invention is to provide a safety trigger operated safety switch for a portable electric power tool that responds to manual pressure to move a switch interconnect member to electrically connect and disconnect a pair of contact members.

A further object of this invention is to provide a safety trigger operated safety switch for an electrical power tool that will respond to manual pressure on its trigger to electrically turn on the power tool, will respond to increased manual pressure due to panic reaction of the operator to electrically turn off the power tool, and will remain electrically turned off until manual pressure on the trigger is removed.

A still further object of this invention is to provide a safety trigger operated panic safety switch for portable electrical power tools that is simple in construction, and can be inexpensively and easily adapted to conventional and presently available electrical power tools having trigger switches.

The novel features which are believed to be characteristic of the invention, both as to its organization and method of operation, together with further objects and advantages thereof, will be better understood from the following description considered in connection with the accompanying drawings in which two embodiments of the invention are illustrated by way of examples. It is to be expressly understood, however, that the drawings are for the purpose of illustration and description only and are not intended as a definition of the limits of the invention.

DESCRIPTION OF THE EMBODIMENTS

Figure 1:
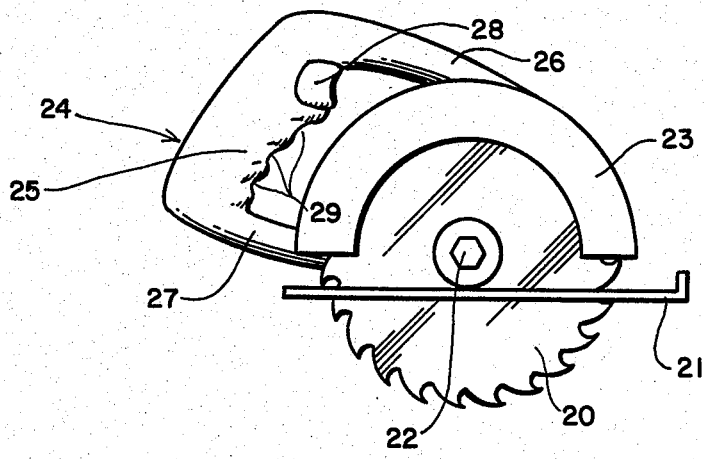
FIG. 1 is a side view of a portable electrical circular saw having a trigger operated panic safety switch of this invention.

Referring now to the figures, an embodiment of a trigger operated panic safety switch of this invention is incorporated in the portable electrical circular saw seen in FIG. 1. A circular cutting blade 20 extends through an opening in work platform 21 on which is mounted an electrical motor (not shown) to rotate the circular cutting blade 20 about axle 22. A guard member 23 is positioned around the cutting blade 20 on the upper side of work platform 21. A handle portion generally designated as 24 includes a hand gripping section 25 with end sections 26 and 27 attached to work platform 21 to provide a handle for the portable electrical circular saw. A pivotable trigger member 28 is located at the upper portion of hand gripping section 25 and finger recesses 29 are formed on the inside portion of hand gripping section 25. A person may hold the portable electrical circular saw with one hand by extending fingers of a hand in the opening between the hand gripping section 25 and the guard member 23 as seen in FIG. 1 with the forefinger in position to actuate the trigger member 28.

Figure 2:
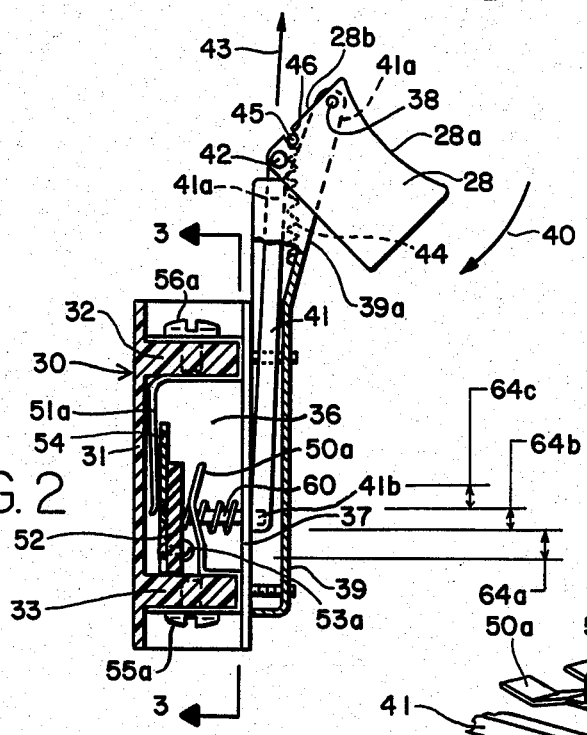
FIG. 2 is an enlarged cross-sectional view of a trigger operated panic safety switch incorporated in the handle of the circular saw seen in FIG. 1, in which the switch enclosure with its elongated chamber is shown in an upright position.
Figure 3:
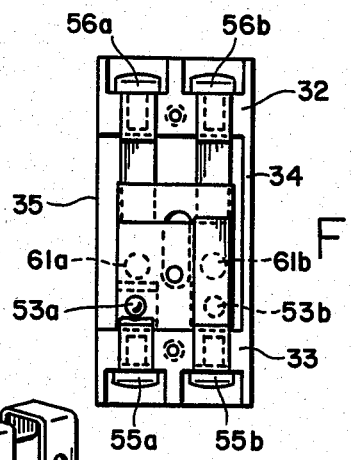
FIG. 3 is a cross-sectional view of the trigger operated panic safety switch as seen along lines 3—3 of FIG. 2.

FIG. 2 shows an enlarged cross-sectional view of the trigger operated safety switch incorporated in the handle portion 24 of the portable electrical circular saw seen in FIG. 1. FIG. 3 is a cross sectional view of the trigger operated safety switch as seen along lines 3—3 of FIG. 2. As shown by these figures, the safety switch includes a switch enclosure 30 having a bottom 31 connected to end walls 32 and 33, which in turn is connected to two side walls 34 and 35 forming an elongated chamber 36. A top member 37 is seen in FIG. 2 covering chamber 36, said top member 37 being connected to end walls 32 and 33 by screws or the like.

Switch enclosure 30 is shown in FIGS. 2 and 3 in its upright position whereby end wall 32 is directly above end wall 33. Trigger member 28 is attached by pin 38 to an extending portion 39*a* of mounting frame 39, which in turn is fixedly connected to top member 37. Trigger member 28 can be turned in the direction of arrow 40 to pivot about pin 38. A connecting rod 41 is connected at its upper end 41*a* to a pin 42 in the lower end of edge 28*b* of trigger member 28 to be moved generally upwards in the direction of arrow 43 as seen in FIG. 2 when trigger member is turned in the direction of arrow 40. A spring 44 is fixedly connected to mounting frame 39 at its lower end and is connected to a rod 45 that is supported in a slot in edge 28*b* of trigger member 28. With no pressure applied to trigger member 28, spring 44 pulls at edge 28*b* to turn trigger member 28 in the position shown in FIG. 2, which is the turn-off position. When trigger member 28 is pressed by the forefinger of a power tool operator to turn in the direction of arrow 40, trigger member will pivot about pin 38 against the force of spring 44. When the pressure on trigger member 28 is released, spring 44 will pull downward at edge 28*b* to return trigger member to the shown turn-off position.

Figure 4:
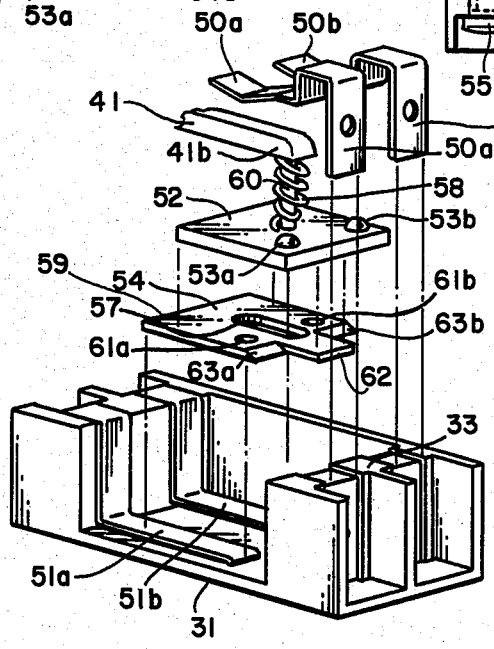
FIG. 4 is an exploded perspective view of the trigger operated panic safety switch seen in FIGS. 2 and 3 in which the switch enclosure is shown in a generally horizontal position.

Referring now also to FIG. 4, the exploded perspective view of the switch means of the trigger operated switch enclosure shows a pair of first switch contact members 50*a* and 50*b*, a pair of second switch contact members 51*a* and 51*b*, an interconnect carrier 52 with a pair of interconnect contacts 53*a* and 53*b*, and flat slide member 54. First contact members 50*a* and 50*b* are fitted around end wall 33 and are respectively connectable to each of two lines of A.C. power by means of threaded screw members 55*a* and 55*b*. Second contact members 51*a* and 51*b* extend along the bottom 31 and over end wall 32 and are respectively connectable by means of threaded screw members 56*a* and 56*b* to each electrical line of the electrical motor to drive the cutting blade 20. Although it is sufficient to open and close the electrical connection of one line of A.C. power in order to switch the power off and on, it is preferable to open and close the electrical connections of both lines. The illustrated embodiment of this trigger operated safety switch shows this preferred arrangement of switching both lines. Accordingly, it will be realized that any desired number of lines may be switched by the trigger operated safety switch of this invention.

A pull rod 60 extends laterally from lower end 41*b* of connecting rod 41 through a hole in interconnect carrier 52, and through a longitudinal slot 57 in slide member 54 (made of insulated material). A spring 58 between interconnect carrier 52 and lower end 41*b* of connecting rod 41 surrounds pull rod 60. Spring 58 presses interconnect carrier 52 towards bottom 31 of switch enclosure 30. A pair of indentations or small depressions 61*a* and 61*b* are formed in the upper side of slide member 54 to receive the bottom portion of interconnect contacts 53*a* and 53*b* respectively. Slide member 54 has cutouts forming a central extending projection 62 to allow the lower portion of interconnect contacts 53*a* and 53*b* to make electrical contact with second switch contact members 51*a* and 51*b* respectively. Beveled edges 63*a* and 63*b* are formed on the sides of the cutouts near indentations 61*a* and 61*b* in slide member 54.

With pressure applied to trigger member 28 in the direction of arrow 40, spring 44 forces connecting rod 41 upwards in the direction of arrow 43. Pull rod 60 is moved by connecting rod 41 to pull carrier 52 towards end wall 32. Contacts 53*a* and 53*b* bear against beveled edges 63*a* and 63*b* to cause slide member 54 to slide in the direction of arrow 43 towards end wall 32. As seen in FIGS. 2, 3 and 4, both sides of interconnect contacts 53*a* and 53*b* are away from first switch contact members 50*a* and 50*b* and from second switch contact members 51*a* and 51*b*. The electrical connections between said first and second contact members are not completed, and the trigger operated switch remains in its off condition. When additional pressure is applied to trigger member 28, it will be further pivoted about pin 38 and be turned more in the direction of arrow 40. Carrier 52 with its contacts 53*a* and 53*b* will move upwards in the direction of arrow 43. During distance 64*a*, contact 53*a* does not make electrical contact with both first switch contact members 50*a* and 51*a*, and contact 53*b* does not make electrical connection with both second switch contact members 50*b* and 51*b*. The switch remains off. The range of movement of interconnect contacts 53*a* and 53*b* of carrier 52, designated herein as 64*a*, is herein called the initial portion of chamber 36 for contacts 53*a* and 53*b*.

Figure 5:
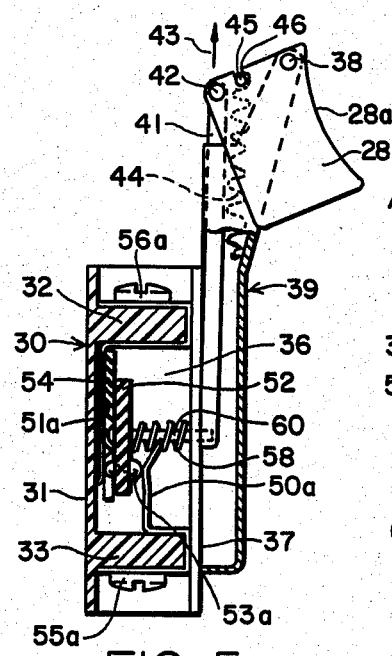
FIG. 5 is a view similar to that of FIG. 2 but showing the position of the interconnect carrier and that of the slide member inside the switch enclosure when the trigger member is pressed to operate the electric power tool having the panic safety switch of this invention.
Figure 6:
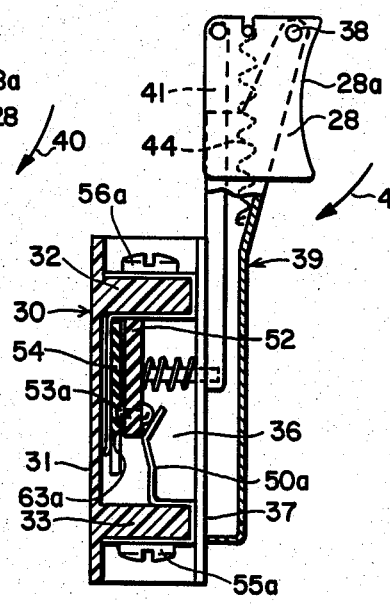
FIG. 6 is a view similar to that of FIG. 2 but showing the position of the interconnect carrier and that of the slide member inside the switch enclosure when the trigger is further pressed due to the reaction of a person operating the power tool with the panic safety switch of this invention.
Figure 7:
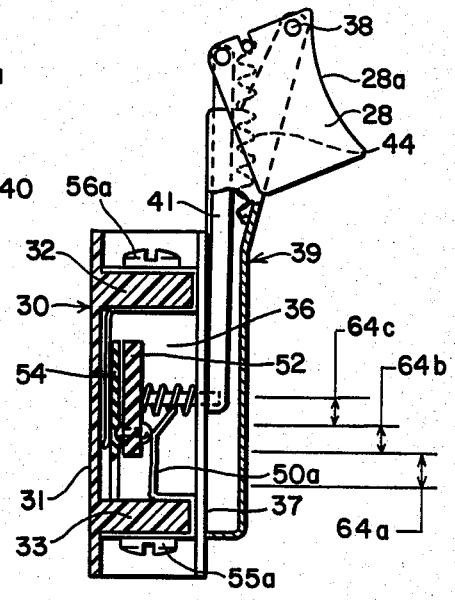
FIG. 7 is a view similar to that of FIG. 2, but showing the position of the interconnect carrier and that of the slide member inside the switch enclosure of the panic safety switch of this invention when the trigger is released after the power tool is electrically disconnected by the instinctive reaction of a person in further pressing the trigger as shown in FIG. 6.

FIGS. 5, 6 and 7 show the several other operating conditions of the trigger operated switch of this preferred embodiment. In FIG. 5, contacts 53*a* and 53*b* of carrier 52 are positioned in the intermediate portion 64*b* of chamber 36 during which the electrical power is applied to the electrical power saw. Trigger member 28 has been further pivoted about pin 38 and turned more in the direction of arrow 40. Pull rod 60 of connecting rod 41 has pulled interconnect carrier 52 upwards so that its contact 53*a* makes electrical contact with both first contact member 50*a* and second contact member 51*a*. At the same time contact 53*b* also makes electrical contact with both first contact members 50*b* and 51*b*. As carrier 52 is moved upwards, its contacts 53*a* and 53*b* will also engage beveled edges 63*a* and 63*b* of slide member 54 to cause slide member 54 to also move upwards thereby allowing continuous electrical contact between contact members 50*a* and 51*a* and between contact members 50*b* and 51*b*, during the range of intermediate portion 64*b*.

As increased pressure is applied to trigger member 28 (e.g., due to a panic reaction), trigger member 28 will be turned to move interconnect carrier 52 further along chamber 36 until edge 59 of slide member 54 engages end wall 32. With slide member 54 stopped against end wall 32, the side of contacts 53*a* and 53*b* pressing against beveled edges 63*a* and 63*b* will be forced on top of slide member 54 against the force of spring 58. Thereafter, contacts 53*a* and 53*b* will be received by and fit inside indentations 61*a* and 61*b* respectively, thereupon, contacts 53*a* and 53*b* of carrier 52 will not make electrical connection with second contact members 51*a* and 51*b*, and the switch will be off. FIG. 6 shows the position of interconnect carrier 52 and slide member 54 when the switch is off due to such increased pressure applied to trigger member 28. In the range indicated as 64*c*, contacts 53*a* and 53*b* of carrier 52 do not electrically interconnect the contact members, and are in the end portion 64*c* of chamber 36 for contacts 53*a* and 53*b*.

FIG. 7 shows the switch being returned to the initial off position when the pressure on trigger member 28 is released. Spring 44 forces connecting rod 41 in the direction opposite of arrow 43, and pull rod 60 will move carrier 52 downwards. Projection 62 of slide member 54 will thereupon engage end wall 33 to stop the movement of slide member 54. The force of spring 44 causes contacts 53*a* and 53*b* to move out of indentations 61*a* and 61*b* against the force of spring 58. Then, carrier 52 can proceed to move further towards end wall 33 and its contacts 53*a* and 53*b* will be returned to initial portion 64*a* of chamber 36 for contacts 53*a* and 53*b*.

In operating an electrical power tool with a safety switch of the preferred embodiment, an operator will press trigger member 28 to turn on the power tool. The power tool is turned off in the usual manner by thereafter releasing the pressure on trigger member 28. However, in the case of a situation causing the operator to press unusually hard on trigger member 28 (such as that due to a panic reaction), then carrier 52 will be moved so that its contacts 53*a* and 53*b* will be away from contact members 50*a* and 50*b*, and due to the interposition of slide member 54 also be away from contact members 51*a* and 51*b*, thus breaking the electrical connection. When this unusual operation situation is over, pressure on trigger member 28 is released, and the power tool returns to its normal initial off condition without being turned on again. In such operation, the thickness of slide member 54, the angle of its beveled edges 63*a* and 63*b*, as well as the strength of spring 58, are factors in determining the amount of additional pressure needed to move contacts 53*a* and 53*b* into end portion 64*c*. Accordingly, these factors can be adjusted to suit the operator so that the "on" condition of the switch can be sensed during normal operation of the power tool with the trigger operated panic safety switch of this invention.

Figure 8:
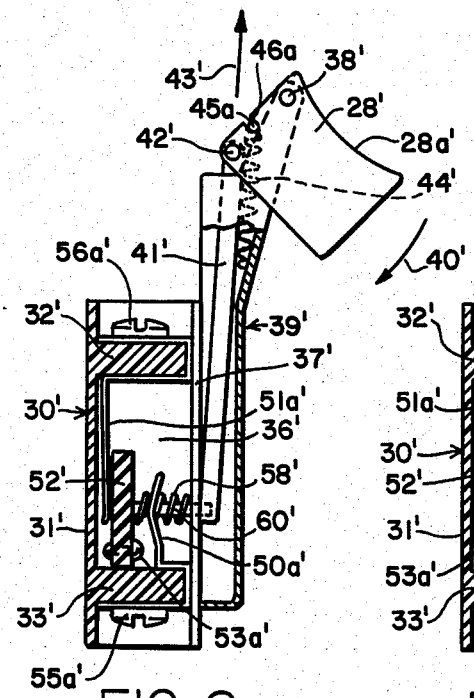
FIG. 8 is an enlarged side view of another embodiment of a safety switch of this invention similar to the view seen in FIG. 2.
Figure 9:
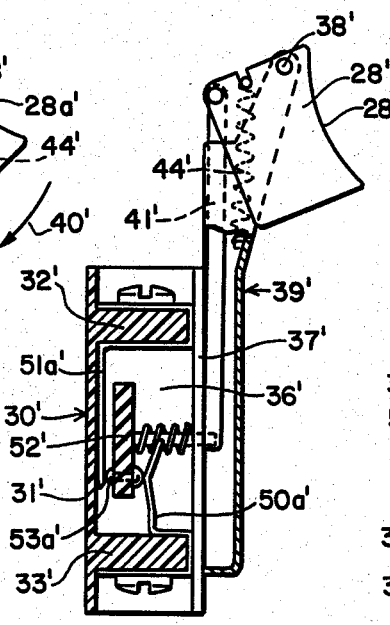
FIG. 9 is a view similar to that of FIG. 8 but showing the position of the interconnect carrier inside the switch enclosure when the trigger member is pressed to operate the electrical power tool having the panic safety switch of this embodiment of this invention.
Figure 10:
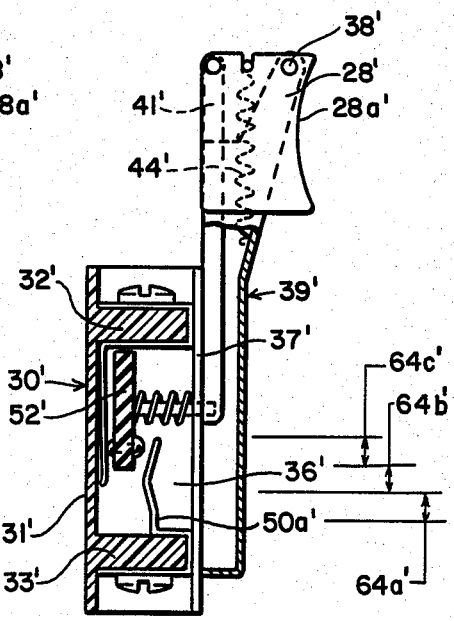
FIG. 10 is a view similar to that of FIG. 8 but showing the position of the interconnect carrier inside the switch enclosure when the trigger is further pressed due to the panic reaction of a person operating the power tool with this embodiment of the panic safety switch of this invention.

Another embodiment of the invention is shown in FIGS. 8, 9 and 10, which have the same parts as those in the prior described embodiment, except for the omission of slide member 54. Corresponding parts have corresponding numerical designations except that a prime (') has been appended to the numerical designations in FIGS. 8, 9 and 10. This embodiment of the switch differs in operation from the prior described embodiment in that interconnect contacts 53*a*' and 53*b*' have no insulated slide member 54 to prevent electrical contact with contact members 51*a*' and 51*b*' when contacts 53*a*' and 53*b*' are in end portion 64*c*' of chamber 36' and during the return to the initial portion 64*a*' of chamber 36'. Accordingly, the operator will then maintain the fully depressed condition of trigger member 28' until ready to fully release trigger member 28' in order to return the tool to the initial off position.

Although, in the above preferred embodiment, trigger member 28 is shown to pivot around pin 38 when pressed, and then this turning movement is translated to a linear movement, it will be realized that trigger member 28 may be arranged to move linearly instead. In that event, connecting rod 41 can be directly driven by trigger 28 to linearly drive carrier 52 as herein described. Similarly, in the other embodiment, trigger member 28' can be caused to slide linearly in response to finger pressure to also linearly drive connecting rod 41'. Further, it will be also realized that the movement of carrier 52 should correspond to the movement of trigger member 28, but that such movement need not necessarily be linear. With these modifications, the operations of the electrical power tool with the safety switch will be similar.

Although the best mode contemplated for carrying out the present invention has been herein shown and described, it will be apparent that modification and variation may be made without departing from what is regarded to be the subject matter of the invention.

What is claimed is:

1. In a portable electrical power tool, a trigger operated switch comprising:

a switch enclosure having a pair of side walls connected to end walls to form a chamber with an initial portion, an intermediate portion, and an end portion;

an interconnect carrier having an interconnect member and being movable along the length of the chamber in the switch enclosure;

first and second electrical contact members being fixedly positioned within the intermediate portion of the chamber and being spaced from each other to be contacted by the intereconnect member;

trigger actuated means connected to drive the interconnect carrier along the chamber in the switch enclosure;

a flat insulator slide member between one of the contact members and the interconnect carrier to be moved by the interconnect member to prevent electrical contact with said contact member after being in the end portion of the chamber, said slide member being released from being moved by the interconnect member when returned to the initial portion of the chamber; and said flat insulator slide member has an indentation and is positioned between one of the contact members and the interconnect carrier to be moved by its interconnect member to have one of the ends of the slide member engage the end wall in the end portion of the chamber of the switch enclosure to have the interconnect member slide on top of the slide member into its detent to be moved by the slide member, said slide member with its interconnect member being movable towards the end wall in the initial portion of the chamber of the switch enclosure to have the other end of the slide member engage the end wall in the initial portion of the elongated chamber of the switch enclosure to have the interconnect member slide out of the indentation and off the top of the slide member.

2. The trigger operated switch of claim 1 in which the trigger actuated means includes a mounting frame connected to the switch enclosure, a trigger member connected to the mounting frame and to the interconnected carrier to linearly move the interconnect carrier along the length of the chamber of the switch enclosure in accordance with the movement of the trigger member.

3. In a portable electrical power tool, a trigger operated panic safety switch comprising:

a switch enclosure having a pair of side walls connected to end walls to form an elongated chamber with an initial portion, an intermediate portion, and an end portion;

an interconnect carrier having an interconnect member and being movable along the length of the elongated chamber in the switch enclosure;

first and second electrical contact members being fixedly positioned within the intermediate portion of the elongated chamber and being spaced from each other to be contacted by the interconnect member;

a trigger member;

a connecting member connecting the trigger member to the interconnect member to translate the movement of the trigger member to a linear movement of the interconnect carrier along the elongated chamber;

said interconnect carrier being in the initial portion and in the end portion of the elongated chamber with its interconnect member away from the first and second contact members, and being in the intermediate portion of the elongated chamber with its interconnect member electrically connecting the first and second contact member; and a flat insulator slide member with a detent, said slide member being positioned between one of the contact members and the interconnect carrier to be moved by its interconnect member to have one of the ends of the slide member engage the end wall in the end portion of the elongated chamber of the switch enclosure to have the interconnect member slide on top of the slide member into its detent to be carried by the slide member, and said slide member with its carried interconnect member being movable towards the end wall in the initial portion of the elongated chamber of the switch enclosure to have the other end of the slide member engage the end wall in the initial portion of the elongated chamber of the switch enclosure to have the interconnect member slide out of the detent and off the top of the slide member.

4. In a portable electrical power tool, a trigger operated panic safety switch comprising:

a mounting frame connectable to the power tool;

a trigger member pivotally connected to the mounting frame;

a switch enclosure having a pair of side walls connected to end walls to form a chamber with an initial portion, an intermediate portion, and an end portion;

first and second electrical contact members being spaced from each other and being positioned to be contacted within the intermediate portion of the chamber;

an interconnect carrier having an electrical interconnect member and being movable within the chamber;

a connecting member connecting the trigger member to the interconnect carrier to translate the movement of the trigger member to a linear movement of the interconnect carrier along the chamber;

said interconnect carrier being in the initial portion of the chamber when no pressure is applied to the trigger member and with its interconnect member positioned away from the first and second contact members;

said interconnect carrier being moved to the intermediate portion of the chamber with pressure applied to the trigger member to position the interconnect member to contact the first and second contact members;

said contact carrier being further moved to the end portion of the chamber with increased pressure applied to the trigger member to position the interconnect member away from the first and second contact members; and a flat insulator slide member with an indentation, said slide member being positioned between one of the contact members and the interconnect carrier to be moved by its interconnect member to have one of the ends of the slide member engage the end wall in the end portion of the chamber of the switch enclosure to have the interconnect member slide on top of the slide member into its indentation to be moved by the slide member, and said slide member with its interconnect member being movable towards the end wall in the initial portion of the chamber of the switch enclosure to have the other end of the slide member engage the end wall in the initial portion of the chamber of the switch enclosure to have the interconnect member move out of the indentation and off the top of the slide member.

* * * * *